US010369440B2

(12) United States Patent
Jolley et al.

(10) Patent No.: US 10,369,440 B2
(45) Date of Patent: Aug. 6, 2019

(54) GOLF TOOL DEVICES

(71) Applicant: Michael Jolley, Portland, OR (US)

(72) Inventors: Michael Jolley, Portland, OR (US); Kenneth Courian, Portland, OR (US)

(73) Assignee: Michael Jolley, Portland, OR (US)

( * ) Notice: Subject to any disclaimer, the term of this patent is extended or adjusted under 35 U.S.C. 154(b) by 0 days.

(21) Appl. No.: 16/197,176

(22) Filed: Nov. 20, 2018

(65) Prior Publication Data

US 2019/0151726 A1 May 23, 2019

Related U.S. Application Data

(60) Provisional application No. 62/588,859, filed on Nov. 20, 2017, provisional application No. 62/633,001, filed on Feb. 20, 2018, provisional application No. 62/650,962, filed on Mar. 30, 2018, provisional application No. 62/669,817, filed on May 10, 2018.

(51) Int. Cl.

| | |
|---|---|
| ***A63B 47/02*** | (2006.01) |
| ***A63B 57/20*** | (2015.01) |
| ***A63B 57/50*** | (2015.01) |
| *A63B 57/30* | (2015.01) |
| *A63B 60/06* | (2015.01) |
| *A63B 53/14* | (2015.01) |

(52) U.S. Cl.

CPC ..... *A63B 57/207* (2015.10); *A63B 47/02* (2013.01); *A63B 57/50* (2015.10); *A63B 53/14* (2013.01); *A63B 57/353* (2015.10); *A63B 60/06* (2015.10)

(58) Field of Classification Search

CPC ..... A63B 57/207; A63B 47/02; A63B 57/50; A63B 53/14; A63B 57/353; A63B 60/06

See application file for complete search history.

(56) References Cited

U.S. PATENT DOCUMENTS 1,452,679 A 4/1923 Fisher
2,834,629 A 5/1958 Williams
(Continued)

FOREIGN PATENT DOCUMENTS

GB 2294404 A 5/1996

OTHER PUBLICATIONS

International Search Report prepared by the US Receiving Office for related PCT/US2018/062125, dated Jan. 16, 2019, 3 pages.
(Continued)

*Primary Examiner* — Stephen L Blau
(74) *Attorney, Agent, or Firm* — Chernoff Vilhauer LLP

(57) ABSTRACT

Golf tool devices and golf clubs having those devices attached to, or incorporated with, their grips are disclosed. In some embodiments, the golf tool device includes a housing and a tool assembly attached to the housing. The tool assembly includes a base jaw and a gripper jaw pivotably connected to the base jaw. The tool assembly additionally includes a spring connected to the gripper jaw and configured to urge the gripper jaw toward the base jaw. The golf tool device additionally includes a mode selector assembly configured to selectively switch operation of the gripper jaw between at least two modes. The at least two modes include a first mode in which the gripper jaw moves in response to urging of the spring, and a second mode in which the gripper jaw is secured in a first position that is spaced away from the base jaw against urging of the spring.

19 Claims, 12 Drawing Sheets

(56) References Cited

U.S. PATENT DOCUMENTS

| | | | | |
|---|---|---|---|---|
| 3,922,027 | A | 11/1975 | Nesselt | |
| 4,017,082 | A | 4/1977 | Channing et al. | |
| 4,616,826 | A | 10/1986 | Trefts | |
| 4,862,970 | A | 9/1989 | Hlavacek | |
| 4,871,029 | A | 10/1989 | Rosin | |
| 4,949,961 | A | 8/1990 | Milano | |
| 5,080,357 | A | 1/1992 | Wolf | |
| 5,087,044 | A | 2/1992 | Okushima | |
| 6,074,311 | A | 6/2000 | Froud et al. | |
| 6,672,977 | B1 | 1/2004 | Colbo et al. | |
| 6,758,762 | B2 | 7/2004 | Markwood | |
| 7,351,158 | B1 | 4/2008 | Bronsveld | |
| 7,527,563 | B1 | 5/2009 | Neu | |
| 8,337,322 | B2 | 12/2012 | Harper | |
| 8,616,994 | B2 | 12/2013 | Kwon et al. | |
| 8,858,354 | B2 | 10/2014 | Pak et al. | |
| 2005/0020388 | A1* | 1/2005 | Smith | A63B 57/0037 473/386 |
| 2007/0219014 | A1* | 9/2007 | Merriman | A63B 47/02 473/286 |
| 2007/0298900 | A1 | 12/2007 | Johnson | |
| 2008/0064521 | A1 | 3/2008 | Panneri et al. | |
| 2014/0012290 | A1 | 1/2014 | Cooper et al. | |
| 2017/0151477 | A1 | 6/2017 | Fallon et al. | |

OTHER PUBLICATIONS

Written Opinion prepared by the US Receiving Office for related PCT/US2018/062125, dated Jan. 16, 2019, 6 pages.

* cited by examiner

GOLF TOOL DEVICES

CROSS-REFERENCE TO RELATED APPLICATIONS

This application claims the benefit of (1) U.S. Provisional Patent Application No. 62/669,817, which was filed on May 10, 2018 and entitled "Golf Club Grip Tool Assembly"; (2) U.S. Provisional Patent Application No. 62/650,962, which was filed on Mar. 30, 2018 and entitled "Golf Club Grip Tool Assembly"; (3) U.S. Provisional Patent Application No. 62/633,001, which was filed on Feb. 20, 2018 and entitled "Golf Club Grip Tool Assembly"; and (4) U.S. Provisional Patent Application No. 62/588,859, which was filed on Nov. 20, 2017 and entitled "Golf Club Grip Tool Assembly." The complete disclosures of the above applications are hereby incorporated by reference for all purposes.

FIELD

This disclosure relates to golfing equipment. More specifically, the disclosed embodiments relate to golf tool devices that may be attached to, or integrated with, a grip, such as a grip of a golf club.

INTRODUCTION

A golfer may make use of multiple golf accessories or tools during typical play. For example, the golfer may use a "divot tool" or ball mark repair tool to repair ball marks on the green, or a ball marker to identify the location of a ball before moving the ball out of the way of another golfer. Using such tools, or even placing or retrieving the ball, typically requires the golfer to bend or crouch to the ground and can therefore be tiring or painful, especially for a golfer with back, hip, or knee ailments or other health problems. Additionally, with several individual tools to carry, a golfer may forget or lose a tool and discover that the tool is missing only when it is needed on the course. Lacking the tool on the course may inconvenience the golfer, any golfers playing with them, and/or any golfers waiting behind them.

SUMMARY

The present disclosure provides systems and apparatuses relating to golf tool devices suitable for integrating into a grip of a golf club or attaching to a grip of a golf club. In some embodiments, the golf tool device includes a housing and a tool assembly attached to the housing. The tool assembly includes a base jaw and a gripper jaw pivotably connected to the base jaw. The tool assembly additionally includes a spring connected to the gripper jaw and configured to urge the gripper jaw toward the base jaw. The golf tool device additionally includes a mode selector assembly configured to selectively switch operation of the gripper jaw between at least two modes. The at least two modes include a first mode in which the gripper jaw moves in response to urging of the spring, and a second mode in which the gripper jaw is secured in a first position that is spaced away from the base jaw against urging of the spring.

In some embodiments, the golf tool device includes a housing, and a tool assembly attached to the housing. The tool assembly includes a base jaw and a gripper jaw pivotably connected to the base jaw. The tool assembly additionally includes a spring connected to the gripper jaw and configured to urge the gripper jaw toward the base jaw. The golf tool device additionally includes means for switching the gripper jaw between at least two modes. The at least two modes include a first mode in which the gripper jaw moves relative to the base jaw in response to urging of the spring, and a second mode in which the gripper jaw is secured in a position that is spaced away from the base jaw against urging of the spring.

Some embodiments provide a golf club including a grip and a shaft having opposed first and second end portions. The first end portion is received in the grip. The golf club additionally includes a club head attached to the second end portion of the shaft, and a tool assembly attached to, or incorporated with, the grip. The tool assembly includes a base jaw, and a gripper jaw pivotably connected to the base jaw. The tool assembly additionally includes a spring connected to the gripper jaw and configured to urge the gripper jaw toward the base jaw. The golf tool device additionally includes a mode selector assembly configured to selectively switch operation of the gripper jaw between at least two modes. The at least two modes include a first mode in which the gripper jaw moves relative to the base jaw in response to urging of the spring, and a second mode in which the gripper jaw is secured in a first position that is spaced away from the base jaw against urging of the spring.

Features, functions, and advantages may be achieved independently in various embodiments of the present disclosure, or may be combined in yet other embodiments, further details of which can be seen with reference to the following description and drawings.

DESCRIPTION

Various aspects and examples of a golf tool attached to, or incorporated with, a grip of a golf club are described below and illustrated in the associated drawings. Unless otherwise specified, a golf tool device and/or its various components may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

Overview

Figure 1:
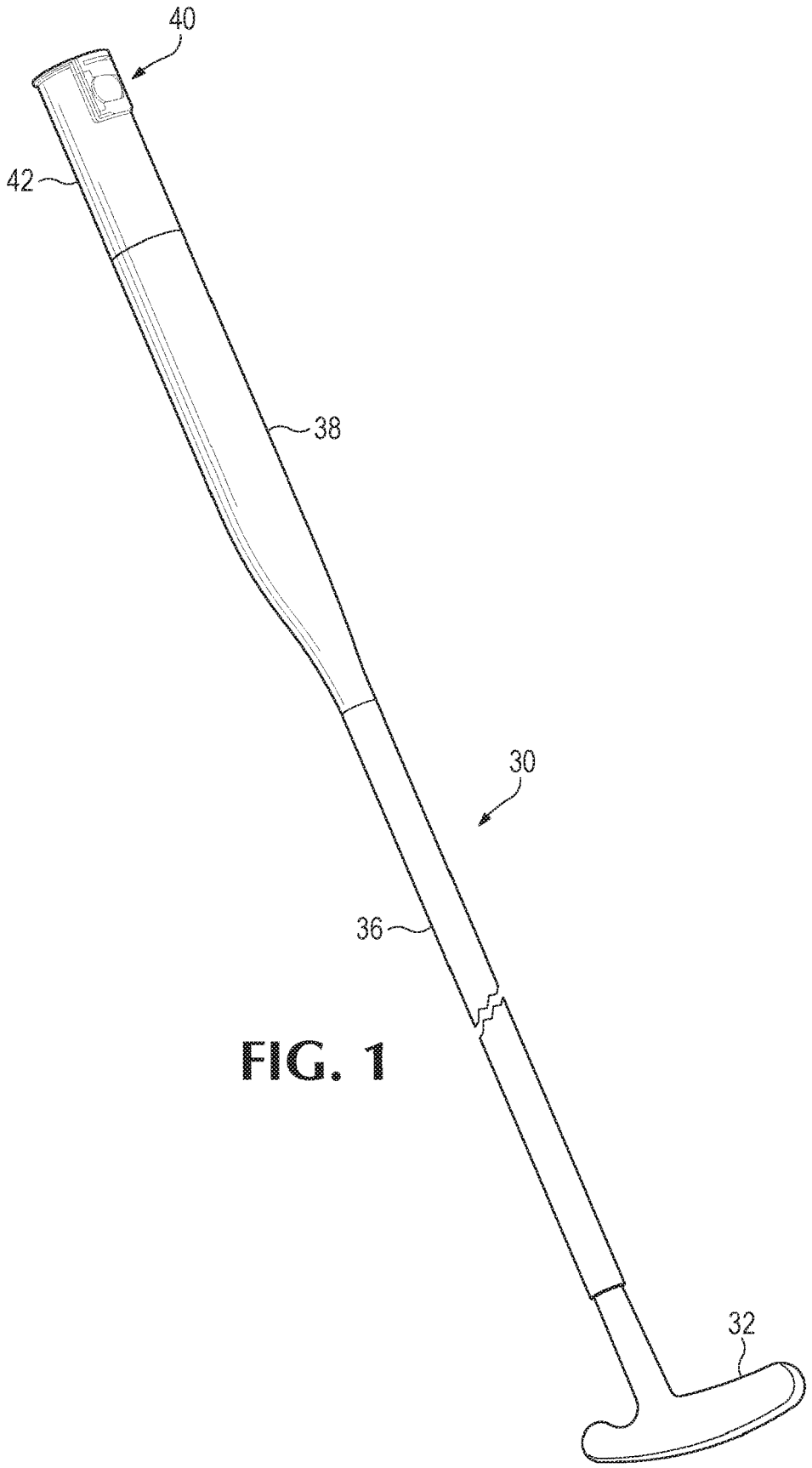
FIG. 1 is an isometric view of a golf club with an example of a golf tool device of the present disclosure.

In general, a golf tool device may include one or more tools or accessories related to the game of golf. The assembly is incorporated with a grip of a golf club or attached to a grip of a golf club. FIG. 1 depicts an illustrative golf club 30. Golf club 30 includes a head 32 configured to strike a golf ball. Head 32 is connected to a lower end of an elongate shaft 36. In some embodiments, club 30 is a putter.

Club 30 includes a grip 38 disposed at an upper end of shaft 36. A golfer maneuvers club 30 by holding grip 38. Grip 38 may include a sleeve or wrapping formed of rubber, leather, or other suitable material to facilitate the golfer holding the club. In the present disclosure, grip 30 includes a golf tool device 40 disposed at an upper end of grip 38. Golf tool device 40 includes a housing 42 integrated into or attached to grip 38 and configured to contain one or more tools. Housing 42 may be formed in a cylinder with openings from which one or more tools can be extended. In some embodiments, housing 42 has a cross-sectional shape that is the same as a cross-sectional shape of the rest of grip 38. Housing 42 may be shaped to conform to standard golf rules regarding the cross-sectional shape and size of putters or other clubs. For example, in some embodiments, a cross-sectional width of housing 42 may be uniform or may decrease monotonically. The size(s) may be chosen to allow the club to be inserted into standard tube liners used in golf bags.

Golf tool device 40 includes one or more golf tools. Illustrative embodiments of golf tool device are described below. In general, to use a tool in golf tool device 40, the golfer may adjust the tool while club 30 is oriented with head 32 near the ground and grip 38 is near eye level of a standing or seated golfer, and then maneuver club 30 such that grip 38 (and therefore golf tool device 40) is near the ground in order to use the desired tool(s). Although golf tool device 40 is shown and described as incorporated or integrated with grip 38, the golf tool device (or portion(s) thereof) may be attached (or connectable) to an existing grip 38. Additionally, although club 30 is shown having head 32 of a putter, the golf tool device may be incorporated with or attached to a grip of a golf club having any suitable head (e.g., wedges, woods, irons, etc.), or incorporated with or attached to a grip of any suitable golf accessory (e.g., umbrella, ball scooper, etc.) or a grip of any other structure. In some embodiments, the golf tool device may be attached to a first end of a pole, such as a telescoping pole, with an opposed second end of that pole having a grip. In other words, the golf tool device may sometimes not be attached or not incorporated with a grip.

Examples, Components, and Alternatives

The following sections describe selected aspects of illustrative golf tool devices as well as related systems and/or methods. The examples in these sections are intended for illustration and should not be interpreted as limiting the entire scope of the present disclosure. Each section may include one or more distinct embodiments or examples, and/or contextual or related information, function, and/or structure.

A. First Illustrative Golf Tool Device

FIGS. 2-12 depict a first illustrative golf tool device 100 that is attached to, or incorporated with, a grip 102 of a golf club. In the example shown in FIGS. 2-12, golf tool device 100 includes a housing 104, a selector assembly 106, and a tool assembly 108 attached to the housing.

Housing 104 includes any suitable structure configured to contain or enclose at least a portion (or a substantial portion) of the tool assembly. In the example shown in FIGS. 2-12, housing 104 includes an opening 109, a channel 110 having a slot 112, at least one aperture 114, and cut-outs 116.

Figure 2:
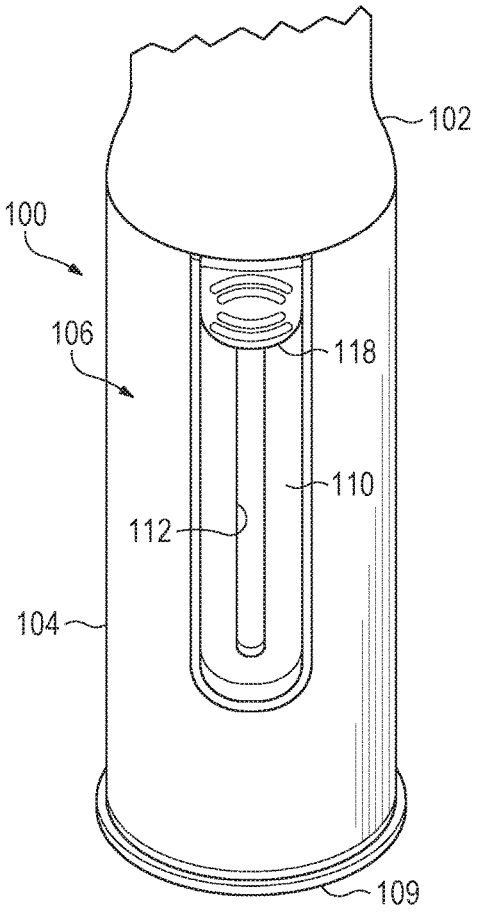
FIG. 2 is a top view of the golf tool device of FIG. 1, showing a tool assembly in a retracted position.
Figure 3:
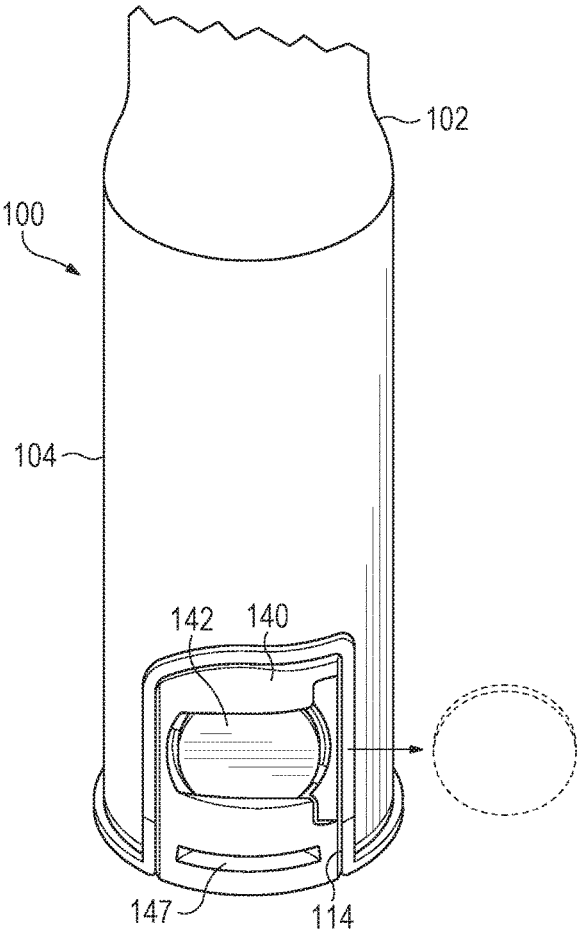
FIG. 3 is a bottom view of the golf tool device of FIG. 1, showing an example of a ball marker assembly of the tool assembly.
Figure 4:
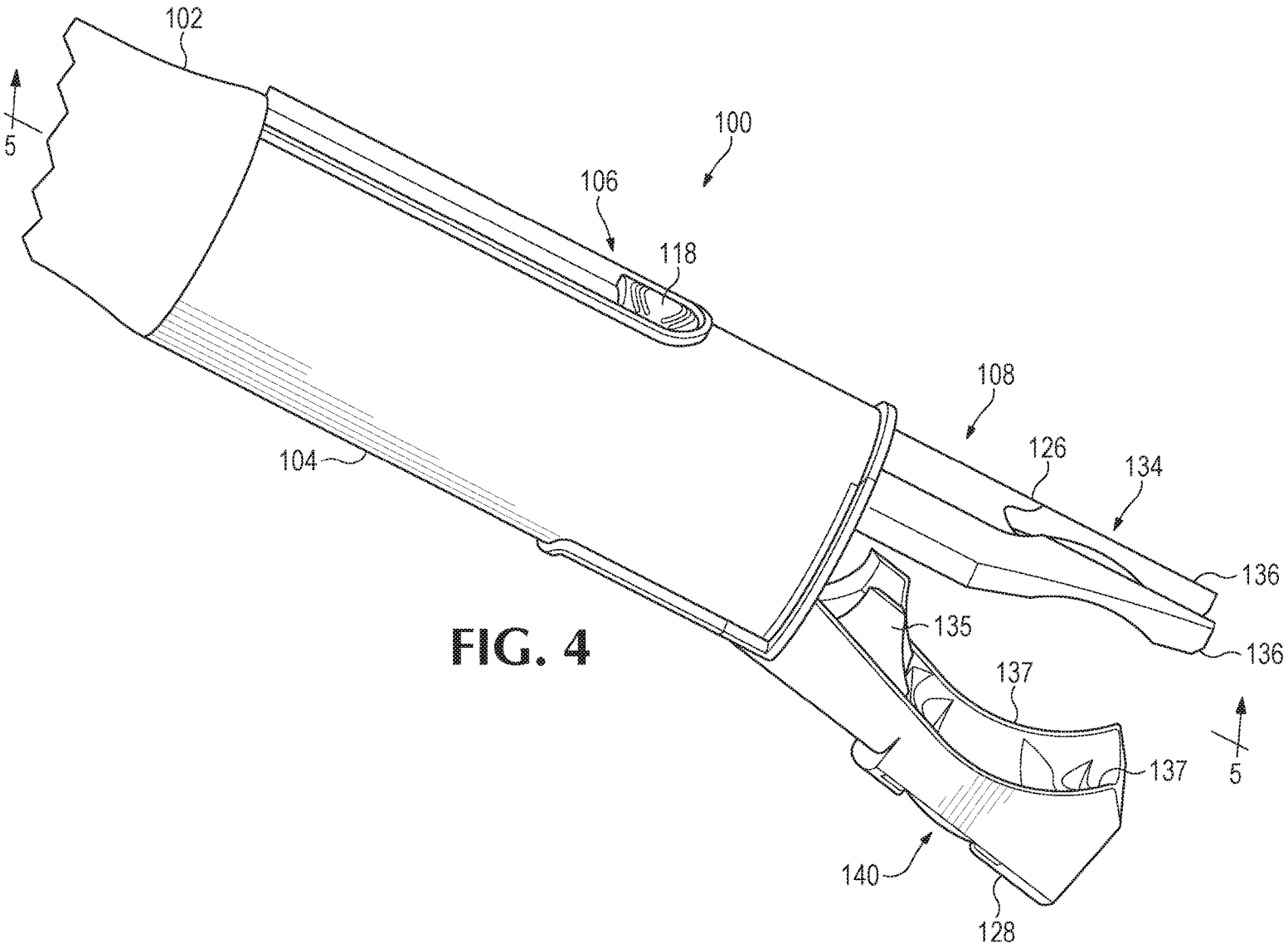
FIG. 4 is a front view of the golf tool device of FIG. 1, showing the tool assembly in an extended position.

In the example shown in FIGS. 2-12, tool assembly 108 is movably (or slidably) attached to the housing to allow the tool assembly to move (or slide) between a retracted position in which at least a substantial portion of the tool assembly is enclosed by the housing as shown in FIGS. 2-3, and an extended position in which at least a substantial portion of the tool assembly is moved through opening 109 and/or is external the housing as shown in FIG. 4. Aperture 114 exposes a portion (or portions) of tool assembly 106 to allow a user to access that portion (or portions) when the tool assembly is in the retracted position. For example, a ball marker assembly (further discussed below) is accessible via the aperture, as shown in FIG. 3. Although housing 104 is shown to include only a single aperture 114, the housing may additionally, or alternatively, include other apertures to expose other portion(s) of the tool assembly. Additionally, although tool assembly 106 is shown to be slidably connected to the housing in the example shown in FIGS. 2-12, the tool assembly may alternatively be pivotably connected to the housing and/or may pivot between retracted and extended positions.

Selector assembly 106 includes any suitable structure attached to the tool assembly configured to move the tool assembly between the extended and retracted positions. In the example shown in FIGS. 2-12, the selector assembly includes a selector button 118, a selector lever 120, and a selector spring 123 (see FIG. 5). Selector button 118 is received within channel 110 for user access to the button. Selector lever 120 includes a protruding portion that is received within one of cut-outs 116 when selector button is moved to one of two ends to lock the tool assembly in the retracted or extended position. Selector spring 123 urges the selector lever 120 toward a cut-out such that the protruding protrusion is received in a cut-out. To move the tool assembly, downward force is applied on the selector button. The selector button engages the selector lever to move the protruding portion out of, or away from, the cut-out against the urging of the selector spring, which then allows the selector button and the tool assembly to be moved.

Tool assembly 108 includes any suitable structure configured to assist a golfer. In the example shown in FIGS. 2-12, tool assembly 108 includes a base 124, a base jaw 126, a gripper jaw 128, a tool spring 130, and a mode selector assembly 132.

Base 124 is attached to selector assembly 106, which allows the selector assembly to move the base (and the tool assembly) between the retracted and extended position. Base jaw 126 is fixedly attached to base 124 and may have any suitable shape(s) configured to facilitate picking up of a golf ball. In the example shown in FIGS. 2-12, base jaw 126 is in the form of a divot tool 134 having tines 136. Although divot tool 134 is shown to include two tines, the divot tool may include at least one tine, such as a single tine, or three or more tines.

Figure 16:
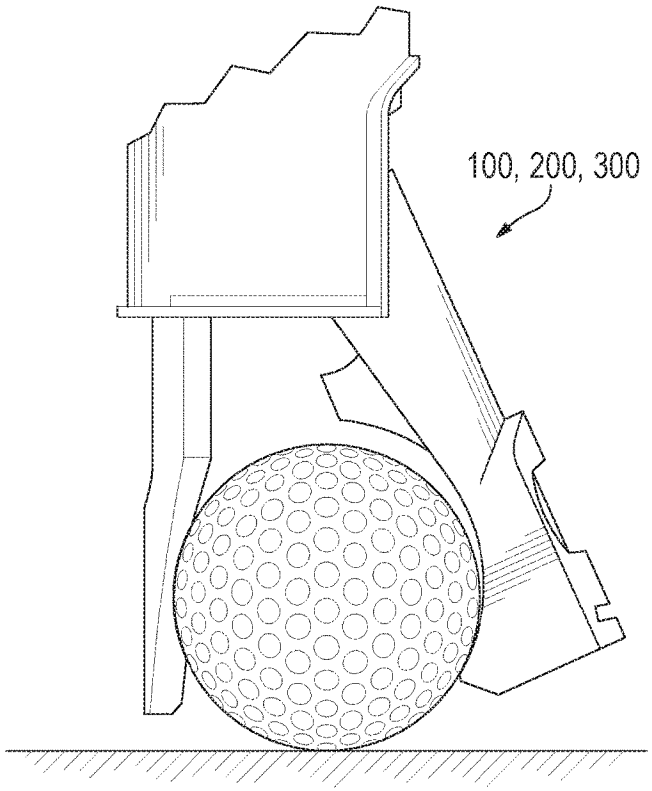
FIG. 16 is a partial view of the golf tool device of FIG. 15 showing the golf ball between a gripper jaw and a base jaw of the golf tool device for picking up a golf ball from a surface or placing a golf ball on a surface.

Gripper jaw 128 is movably or pivotably attached to base 124 and configured to move among a plurality of positions relative to the base jaw. The gripper jaw may have any suitable shape(s) configured to facilitate picking up of a golf ball (such as between the base jaw and the gripper jaw). In the example shown in FIGS. 2-12, gripper jaw 128 includes tangs 135, arcuate surfaces 137, and a jaw ramp 138. The tangs allow a user to move gripper jaw outward (or away from the base jaw) to change the operating mode of the gripper jaw by pushing down on a golf ball that is between the base jaw and the gripper jaw (further discussed below). The arcuate surfaces conform or correspond to the shape of a golf ball to allow the gripper jaw to partially surround the golf ball (as shown in FIG. 16). Jaw ramp 138 contacts a jaw pusher 139 of housing 104 as the tool assembly is being moved to the extended position to push the gripper jaw outward to a nominal or initial position such that the gripper jaw is ready for use once the tool assembly is in the extended position. In the example shown in FIGS. 2-12, the nominal or initial position of the gripper jaw is about 8 to 12 degrees relative to the base jaw.

Figure 5:
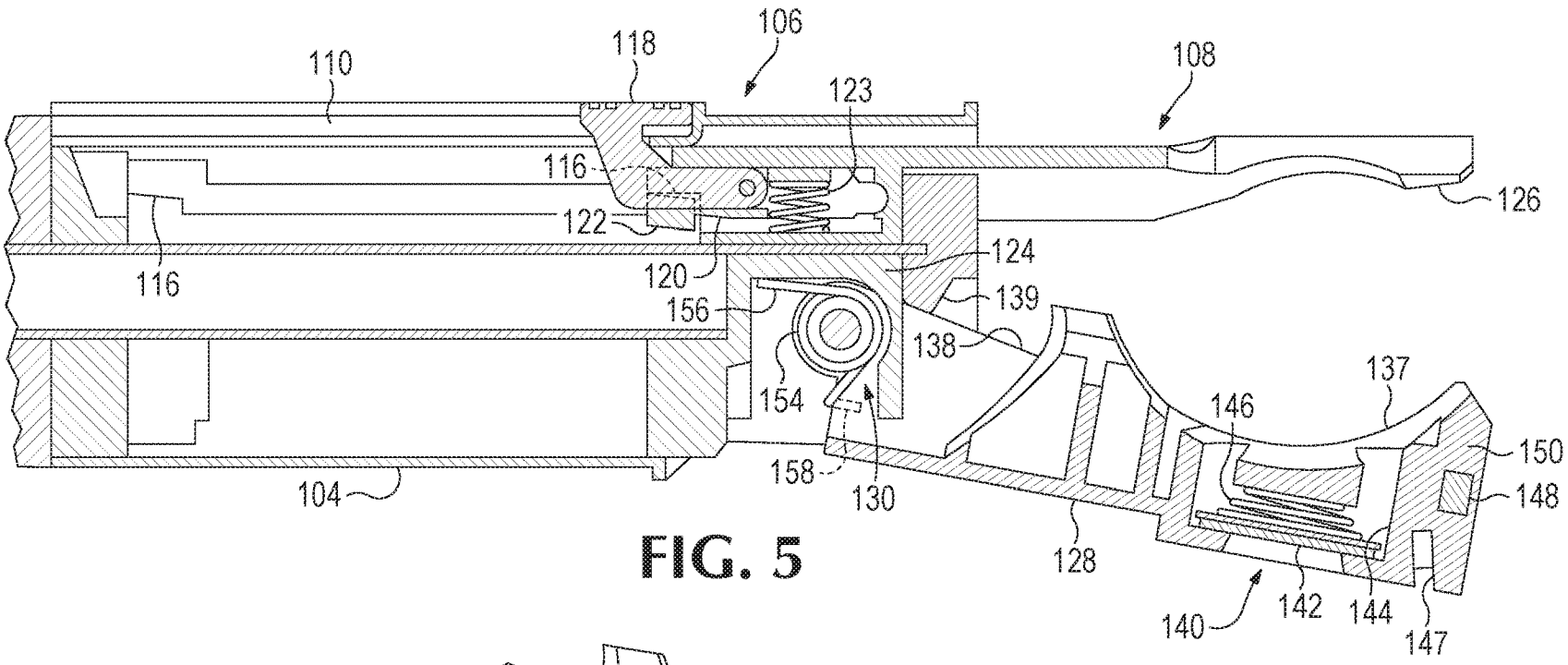
FIG. 5 is a sectional view of the golf tool device of FIG. 1 taken along lines 5-5 in FIG. 4.
Figure 6:
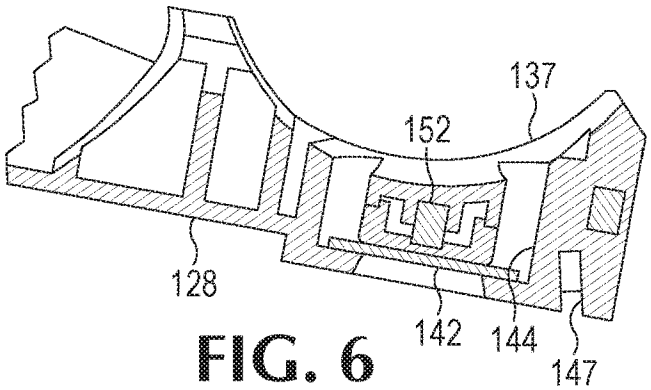
FIG. 6 is a partial view of the golf tool device of FIG. 5 showing another example of a ball marker assembly.

Additionally, gripper jaw 128 includes a ball marker assembly 140 for storing one or more ball markers 142. In FIG. 5, ball marker assembly 140 includes a ball marker storage slot 144, a ball marker spring 146, a ball marker placement slot 147, and a ball marker pick up magnet 148 at an end portion 150 of the gripper jaw. The ball marker slot receives one or more ball markers and the ball marker spring maintains the ball marker(s) in the slot. Ball marker placement slot 147 receives only a portion of a ball marker (e.g., less than half of the ball marker) for placement on a surface. Ball marker pick up magnet 148 allows a user to pick up a previously placed ball marker by placing end portion 150 of gripper jaw 128 adjacent to (or proximate) a ball marker. Alternatively, ball marker assembly 140 may include a storage magnet 152 to maintain the ball marker(s) in the ball marker slot, as shown in FIG. 6.

Tool spring 130 includes any suitable structure configured to urge the gripper jaw toward the base jaw, such as when the gripper jaw is moved outward (or away from the base jaw) beyond its nominal or initial position. In the example shown in FIGS. 2-12, tool spring 130 is a coil spring 154 having a first end 156 that rests against base 124, and a second end 158 that is received within an opening 160 of the gripper jaw. Although tool spring 130 is shown to be in the form of a coil spring, the tool spring may alternatively be in the form of a leaf spring, music wire, and/or other resilient element.

Mode selector assembly 132 includes any suitable structure configured to select between at least two operating modes for the gripper jaw, such as a ball pick-up mode and a ball placement mode. In the ball pick-up mode, the gripper jaw moves relative to the base jaw in response to urging of the spring. In other words, when the gripper jaw is moved away from the base jaw (or its nominal position), the tool spring urges the gripper jaw to move toward the base jaw back to its nominal position and the gripper jaw response to the urging of the tool spring and moves back toward and to the nominal position. For example, when the tool assembly is pushed against a golf ball (e.g., when golf ball is between the base jaw and the gripper jaw), the gripper jaw is pushed away from its nominal position and the tool spring urges the gripper jaw to move toward the base jaw to secure the ball between the base jaw and the gripper jaw.

In the ball placement mode, the gripper jaw is secured in a position that is spaced from the base jaw (and away from its nominal position) against the urging of the tool spring. In other words, the tool spring is acting on or urging the gripper jaw to move toward the base jaw (such as back to its nominal position) but the gripper jaw remains in the same position spaced from the base jaw. In the ball placement mode, for example, a user can release the golf ball because the gripper jaw is secured in a position that is spaced from the base jaw and is not moving in response to the urging of the tool spring.

In the example shown in FIGS. 2-12, the mode selector assembly is configured to select additional operating modes for the gripper jaw, such as a pre-ball placement mode and a divot repair mode. The gripper jaw acts similar in the pre-ball placement mode as in the ball pick-up mode in which the gripper jaw moves in response to the urging of the tool spring but movement of the gripper jaw toward the base jaw is limited in the pre-ball placement mode. However, in the pre-ball placement mode, the gripper jaw can still move outward (or away from the base jaw) to accommodate a golf ball against the urging of the spring and then move toward the base jaw in response to urging of the spring to secure the golf ball between the base jaw and the gripper jaw.

In the divot repair mode, the gripper jaw is secured in a position that is spaced from the base jaw (and away from its nominal position) against urging of the tool spring similar to the ball placement mode. However, the gripper jaw is spaced more from the base jaw in the divot repair mode relative to the ball placement mode. In other words, the gripper jaw is pivoted further away from the base jaw and secured in that position against urging of the tool spring. In the example shown in FIGS. 2-12, the gripper jaw is about eighty to ninety degrees relative to the base jaw, which may allow a user to use the base jaw without interference from the gripper jaw (such as for repairing divots when the base jaw includes a divot tool).

Figure 7:
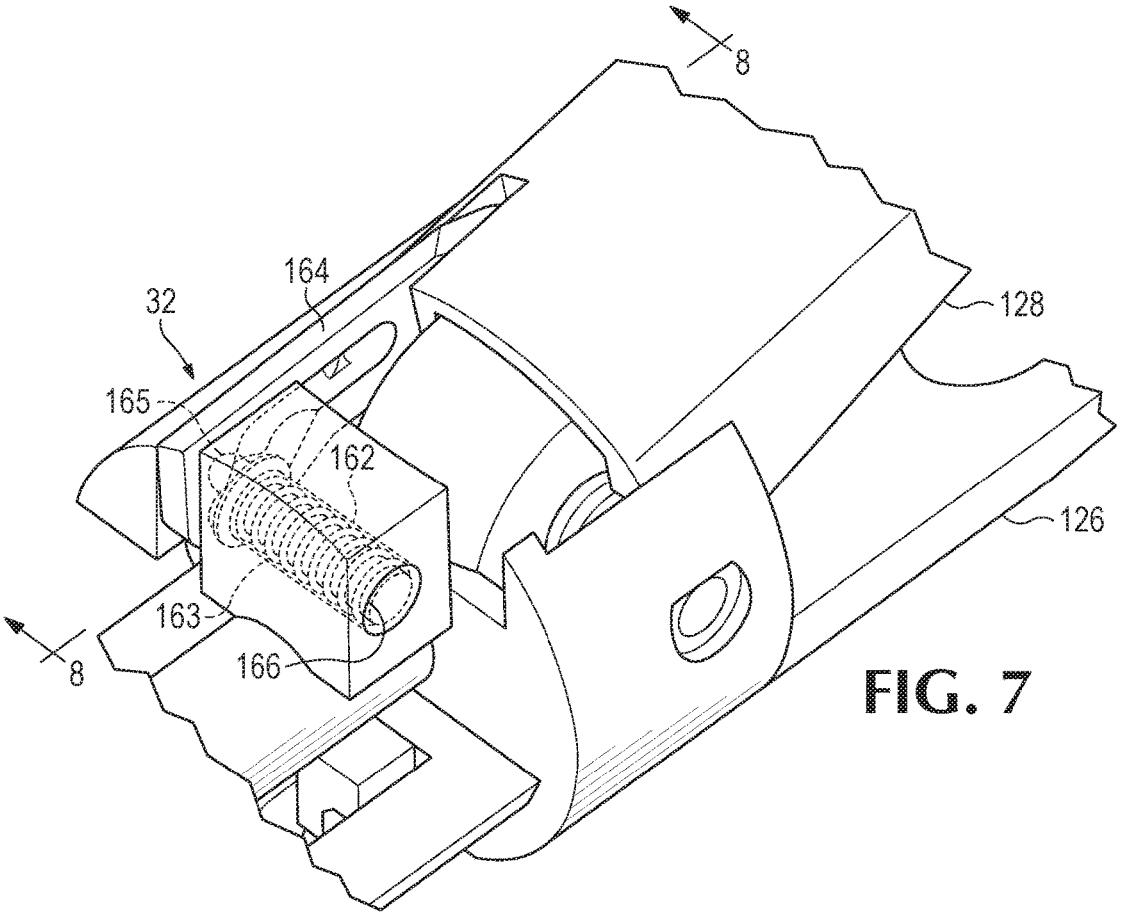
FIG. 7 is a partial isometric view of the tool assembly of the golf tool device of FIG. 1.

In the example shown in FIGS. 2-12, mode selector assembly 132 includes a case 162 having a case spring 163 and a projecting member 165 (such as a ball, rod, or pin), and a detent slide 164. Case 162 is an at least substantially hollow shell of any suitable shape, such as cylindrical, configured to house the spring and projecting member. The case is received in an opening 166 of base 124 to fixedly attach the case to base 124, as shown in FIG. 7. In other words, the case is held stationary as the gripper jaw and detent slide pivot. A first end portion of projecting member 165 is received in the case, and a second end portion of the projecting member extends out of opening 166 and is received in one or more recesses of detent slide 164, as further discussed below. Case spring 163 urges projecting member 165 toward the one or more recesses (or away from the base jaw). Projecting member 165 and its spring may sometimes be referred to as a "spring-loaded pin," "spring plunger," or "ball plunger." Examples of suitable spring-loaded pins in their cases are referred to as "ball plungers" at pivotpins.com and "spring and ball plungers" at catalog-.monroeengineering.com.

Figure 8:
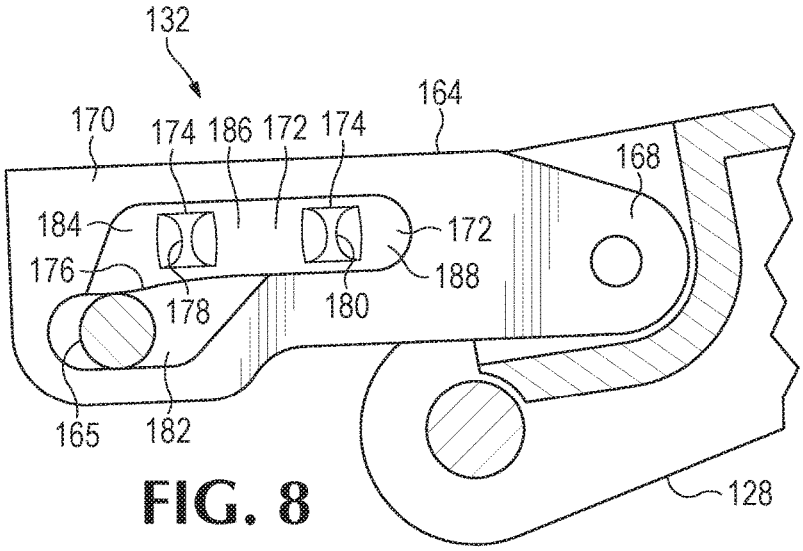
FIG. 8 is a partial sectional view of the golf tool device of FIG. 1 taken along lines 8-8 in FIG. 7, showing a projecting member received within a recess of a detent slide.

Detent slide 164 includes an end portion 168 that is pivotably attached to the gripper jaw. The pivotable attachment of end portion 168 to the gripper jaw is adjacent to, but spaced from, the gripper jaw pivotable attachment to base 124, as shown in FIGS. 8-12. The detent slide includes a detent base 170 having one or more recesses 172 sized to receive projecting member 165 and one or more walls 174. The walls define distinct areas or regions for operation of the gripper jaw. In the example shown in FIGS. 2-12, walls 174 include a first wall 176, a second wall 178, and a third wall 180, as shown in FIG. 8.

Figure 9:
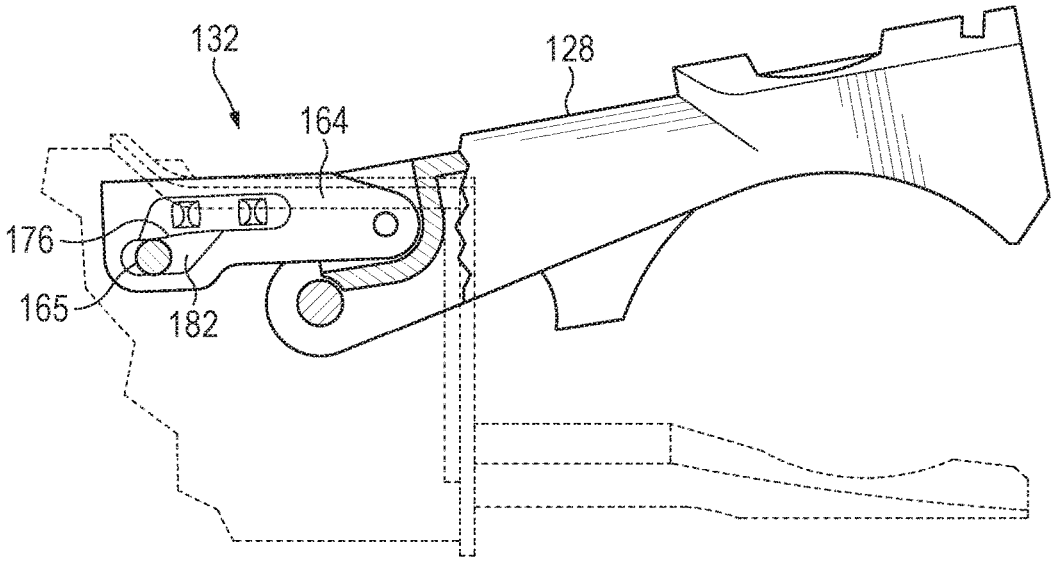
FIG. 9 is a partial sectional view of the golf tool device of FIG. 1, showing the projecting member received in a recess of the detent slide when the tool assembly is initially moved to an extended position.
Figure 10:
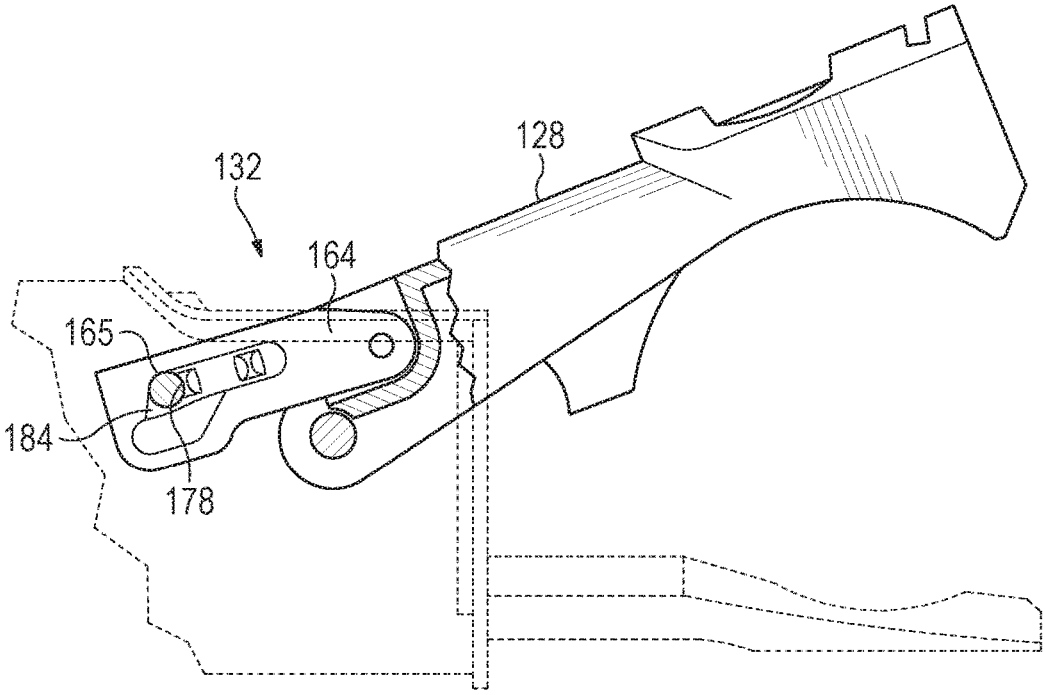
FIG. 10 is a partial sectional view of the golf tool device of FIG. 1, showing the projecting member received in another recess of the detent slide when a gripper jaw of the tool assembly is moved away from a base jaw.

First wall 176 separates a first region 182 from second region 184, third region 186, and fourth region 188 of recess(es) 172. When tool assembly is initially moved to the extended position from the retracted position, projecting member 165 is received in first region 182, as shown in FIG. 9. In that region, the gripper jaw is in the ball pick-up mode in which the gripper jaw moves in response to the urging of the tool spring. First wall 176 maintains projecting member 165 within first region 182 and/or prevents projecting member 165 from entering the other regions.

A manual or external force must be applied to pivot or move gripper jaw away from base jaw to move projecting member 165 over first wall 176 and into another region, such as second region 184. The manual force is a force applied on the gripper jaw that is separate and additional to the gravitational forces acting on the gripper jaw (regardless of the orientation of the gripper jaw). The applied force can be, for example, from a user grasping the gripper jaw and pivoting the gripper jaw away from the base jaw, from a user pushing downward on the golf tool device when a golf ball is between the base jaw and the gripper jaw and the golf ball is on a surface to allow the tangs of the gripper jaw to contact and move the gripper jaw outward, or from pushing the gripper jaw against a surface to pivot the gripper jaw away. A user must pivot the gripper jaw away from the base jaw to a first predetermined angle relative the base jaw to move projecting member 165 over first wall 176. In the example shown in FIGS. 2-12, a user must pivot the gripper jaw away from the base jaw from about 10 degrees relative to the base jaw to about 18 to 22 degrees relative to the base jaw to move projecting member 165 over first wall 176.

When a manual force is applied to the gripper jaw to move projecting member 165 over first wall 176, projecting member 165 is received in second region 184, as shown in FIG. 9. In that region, the gripper jaw is in a pre-ball placement mode in which the gripper jaw moves in response to the urging of the tool spring (similar to the ball pick-up mode) but movement of the gripper jaw toward the base jaw is limited by first wall 176. The gripper jaw is more spaced from the base jaw when projecting member 165 is received in the second region as compared to when projecting member 165 is received in the first region. However, the gripper jaw is still able to pivot outward (or away from the base jaw) against the urging of the tool spring to accommodate a golf ball and is still urged by the tool spring toward the base jaw to secure the golf ball between the gripper jaw and the base jaw.

First wall 176 and second wall 178 maintain projecting member 165 within second region 184 and/or prevents projecting member 165 from entering other regions. A manual or external force must be applied that pivots the gripper jaw either (1) toward the base jaw to move projecting member 165 over first wall 176 and into the first region, or (2) outward or away from the base jaw to move projecting member 165 over second wall 178 and into the third region. The manual force is a force separate and additional to the gravitational forces acting on the gripper jaw (regardless of its orientation) and, when applicable, the urging of the tool spring. In other words, both the urging of the tool spring and the gravitational forces acting on the gripper jaw are not sufficient to move projecting member 165 over first wall 176 without the application of an additional external force by the user.

The additional force can be from a user grasping the gripper jaw and pivoting that jaw outward or inward (or from a user pressing the gripper jaw against a surface), or from a user pushing the golf tool device downward when a golf ball is between the base jaw and the gripper jaw and the golf ball is on a surface to allow the tangs of the gripper jaw to contact the golf ball and move the gripper jaw outward or away from the base jaw. In the example shown in FIGS. 2-12, a user must pivot the gripper jaw toward the base jaw from a position in which the gripper jaw is about 18-20 degrees relative to the base jaw to another position in which the gripper jaw is about 10 to 12 degrees relative to the base jaw to move projecting member 165 over first wall 176, or pivot the gripper jaw away from the base jaw from a position in which the gripper jaw is about 20 to 24 degrees relative to the base jaw to another position in which the gripper jaw is about 45 to 50 degrees relative to the base jaw to move projecting member 165 over second wall 178.

Figure 11:
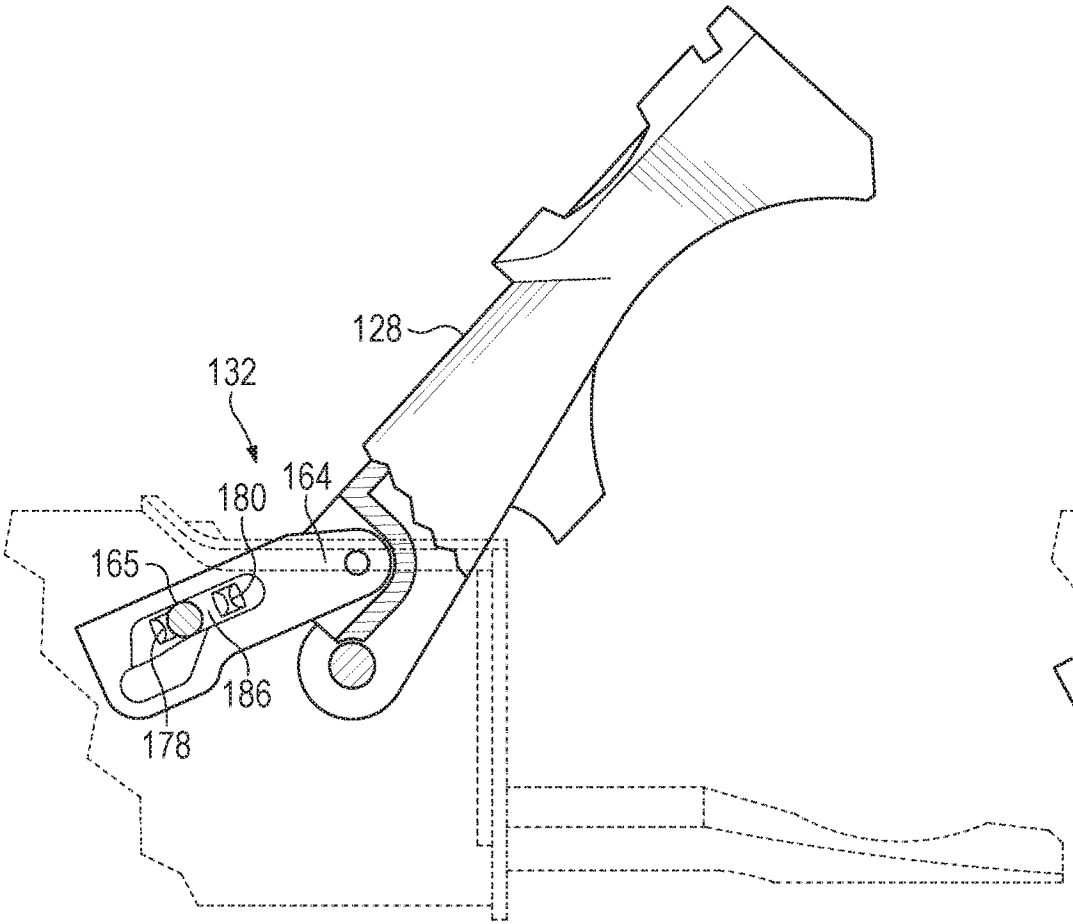
FIG. 11 is a partial sectional view of the golf tool device of FIG. 1, showing the projecting member received in a further recess of the detent slide when the gripper jaw is moved further away from the base jaw.

When a manual force is applied to the gripper jaw to move projecting member 165 over second wall 178, projecting member 165 is received in third region 186, as shown in FIG. 11. In that region, the gripper jaw is in the ball placement mode in which the gripper jaw is spaced from the base jaw against urging of the tool spring to allow a user to release the golf ball and lift the tool assembly away from the golf ball that was just placed on a surface. The gripper jaw is more spaced (or more away from the base jaw) in the ball placement mode as compared to when the gripper jaw is in the pre-ball placement mode.

Second wall 178 maintains projecting member 165 within the third region and/or prevents projecting member 165 from entering second region 184. A manual or external force must be applied that pivots the gripper jaw either (1) toward the base jaw to move projecting member 165 over second wall 178 and into the second region, or (2) outward or away from the base jaw to move projecting member 165 over third 180 and into the fourth region. The manual force is a force that is separate and additional to the gravitational forces acting on the gripper jaw (regardless of its orientation) and, when applicable, the urging of the tool spring. In other words, both the urging of the tool spring and the gravitational forces acting on the gripper jaw are not sufficient to move projecting member 165 over second wall 178 without the application of an additional external force by the user.

The additional force can be from a user grasping the gripper jaw and pivoting that jaw outward or inward (or from a user pressing the gripper jaw against a surface), or from a user pushing the golf tool device downward when a golf ball is between the base jaw and the gripper jaw and the golf ball is on a surface to allow the tangs of the gripper jaw to contact the golf ball and move the gripper jaw outward or away from the base jaw. In the example shown in FIGS. 2-12, a user must pivot the gripper jaw toward the base jaw from a position in which the gripper jaw is about 45 to 50 degrees relative to the base jaw to another position in which the gripper jaw is about 20 to 24 degrees relative to the base jaw to move projecting member 165 over first wall 176, or pivot the gripper jaw away from the base jaw from a position in which the gripper jaw is about 45 to 50 degrees relative to the base jaw to another position in which the gripper jaw is about 80 to 90 degrees relative to the base jaw to move projecting member 165 over second wall 178.

Figure 12:
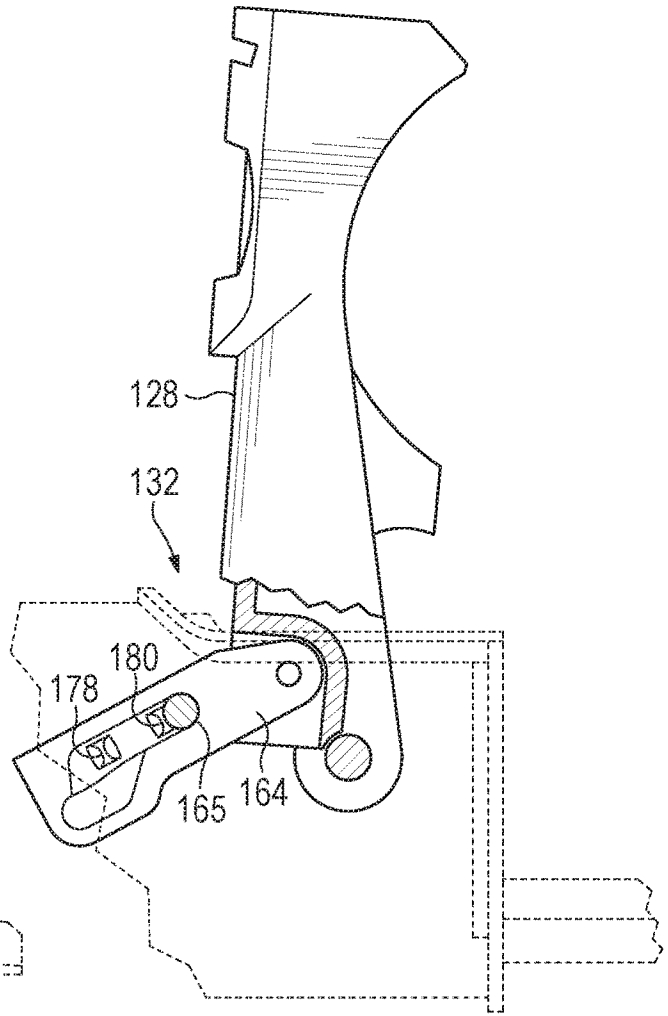
FIG. 12 is a partial sectional side view of the golf tool device of FIG. 1, showing the projecting member received in a different recess of the detent slide when the gripper jaw is moved even further away from the base jaw.

When a manual force is applied to the gripper jaw to move projecting member 165 over third wall 180, projecting member 165 is received in fourth region 188, as shown in FIG. 12. In that region, the gripper jaw is in the divot repair mode in which the gripper jaw is spaced from the base jaw against urging of the tool spring to allow a user to use the base jaw to repair a surface without interference from the gripper jaw. The gripper jaw is more spaced (or more away from the base jaw) in the divot repair mode as compared to when the gripper jaw is in the ball placement mode. In the example shown in FIG. 12, the gripper jaw is about 80 to 90 degrees relative to the base jaw.

Third wall 180 maintains projecting member 165 within the fourth region and/or prevents projecting member 165 from entering third region 184. A manual or external force must be applied that pivots the gripper toward the base jaw to move projecting member 165 over the third wall and into the third region. The manual force is a force that is separate and additional to the gravitational forces acting on the gripper jaw (regardless of its orientation) in combination with urging of the tool spring. In other words, both the urging of the tool spring and the gravitational forces acting on the gripper jaw are not sufficient to move projecting member 165 over third wall 180 without the application of an additional external force by the user.

The additional force can be from a user grasping the gripper jaw and pivoting that jaw outward or inward (or from a user pressing the gripper jaw against a surface), or from a user pushing the golf tool device downward when a golf ball is between the base jaw and the gripper jaw and the golf ball is on a surface to allow the tangs of the gripper jaw to contact the golf ball and move the gripper jaw outward or away from the base jaw. In the example shown in FIGS. 2-12, a user must pivot the gripper jaw toward the base jaw from a position in which the gripper jaw is about 80 to 90 degrees relative to the base jaw to another position in which the gripper jaw is about 45 to 50 degrees relative to the base jaw to move projecting member 165 over third wall 180. The user may then further pivot the gripper jaw toward the base jaw as described above to move projecting member 165 over the second and/or first walls.

Although the detent slide is shown to include four recesses separated by three walls, the detent slide may alternatively include only two recesses separated by a single wall (such as the first wall in the above example without the second and third walls). In that example, the golf tool device would include only a ball pick-up mode and a ball placement mode. Other examples may include only three recesses separated by two walls (such as the first and third walls in the above example without the second wall). In that example, the golf tool device would include only a ball pick-up mode, a ball placement mode, and a divot repair mode. Additionally, although the detent slide is shown to include a plurality of recesses, the detent slide may alternatively, or additionally, include contours, such as projections or crests, that interact with the projecting member. Moreover, although the detent slide is shown to pivot with the gripper jaw with the projecting member being fixedly attached to the base jaw, the projecting member may alternatively pivot with the gripper jaw and the detent slide may be fixedly attached to the base jaw. Furthermore, although the mode selector assembly includes a projecting member loaded by a spring, the mode selector assembly may sometimes exclude the spring and the projecting member may be made of flexible or resilient material(s).

B. Second Illustrative Golf Tool Device

Figure 13:
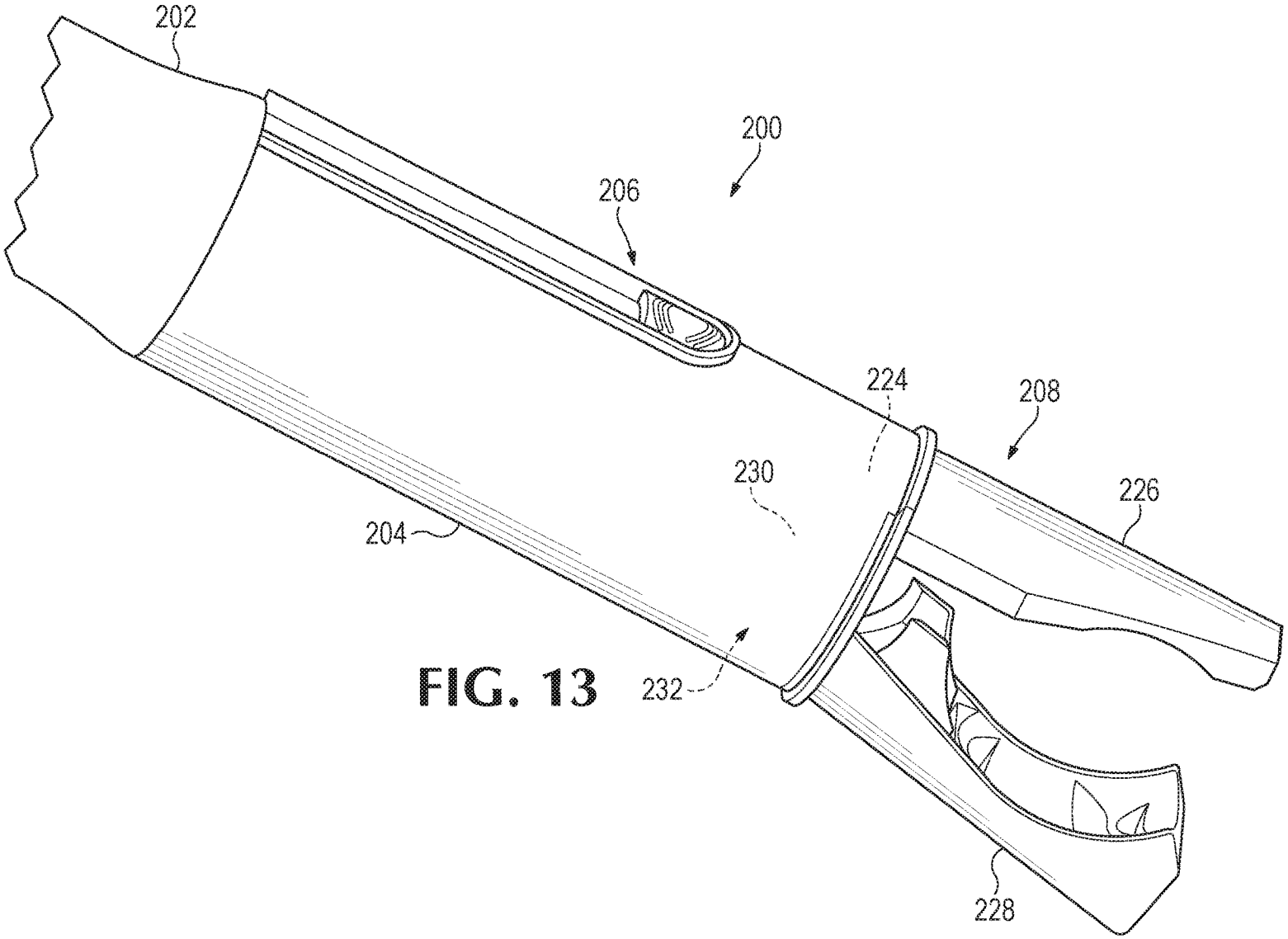
FIG. 13 is an isometric view of another example of a golf tool device of the present disclosure.

FIG. 13 depicts a second illustrative golf tool device 200 that is attached to, or incorporated with, a grip 202 of a golf club. Unless explicitly stated otherwise, golf tool device 200 includes the same or similar components as golf tool device 100. Golf tool device 200 includes a housing 204, a selector assembly 206, and a tool assembly 208 attached to the housing.

Tool assembly 208 includes a base 224, a base jaw 226, a gripper jaw 228, a tool spring 230, and a mode selector assembly 232. However, unlike tool assembly 108, base jaw 226 is not in the form of a divot tool (or does not include a divot tool). Additionally, gripper jaw 228 does not include a ball marker assembly unlike gripper jaw 128 of tool assembly 108. In other examples, golf tool device may have a base jaw 226 in the form of a divot tool or may include a ball marker assembly that is the same or similar to ball marker assembly 140.

C. Third Illustrative Golf Tool Device

Figure 14:
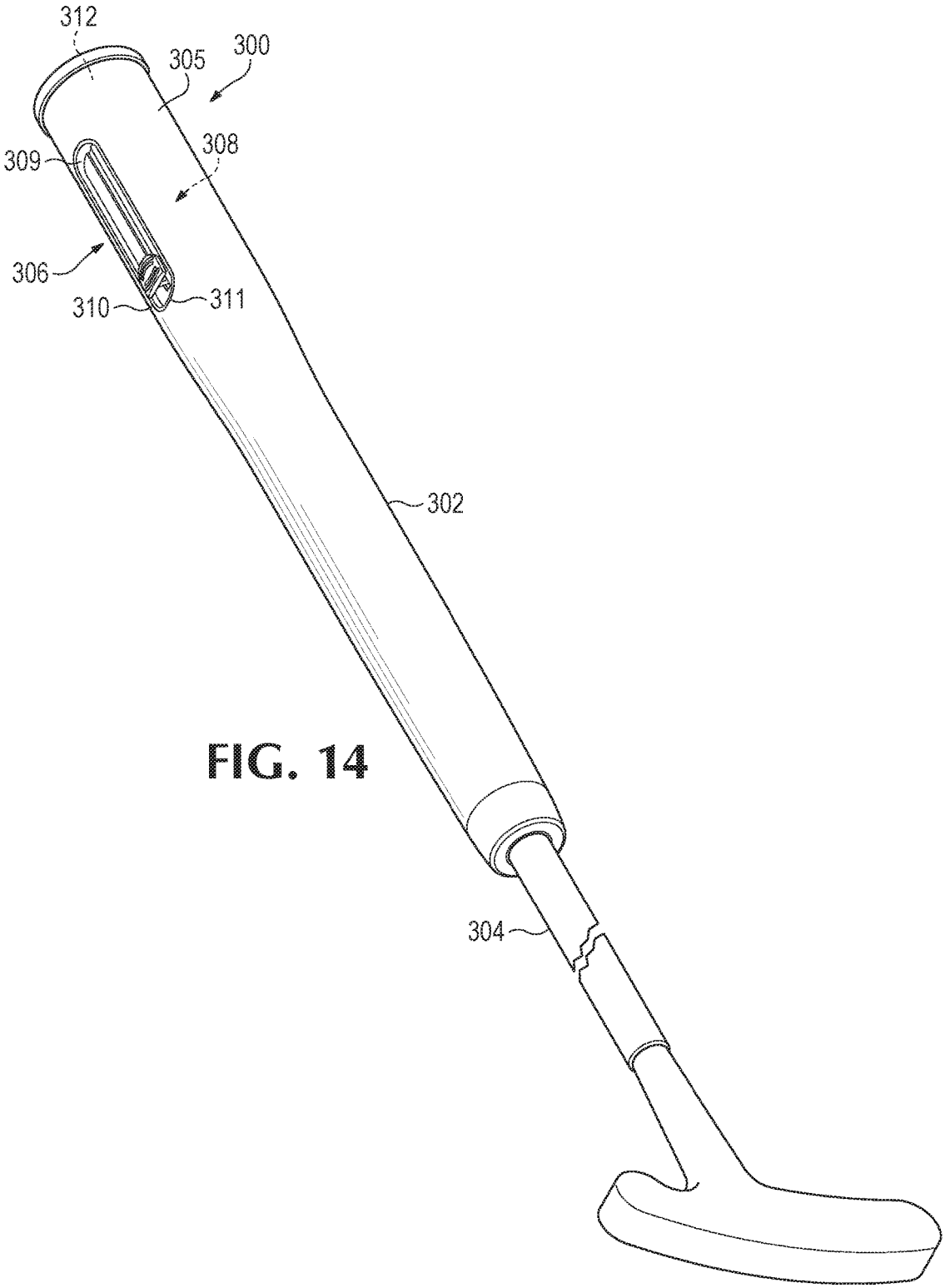
FIG. 14 is an isometric view of a golf club having a further example of a golf tool device of the present disclosure.

FIG. 14 depicts a third illustrative golf tool device 300 that is attached to, or incorporated with, a grip 302 of a golf club 304, such as a putter. Unless explicitly stated otherwise, golf tool device 300 includes the same or similar components as golf tool devices 100 and/or 200. Golf tool device 300 includes a housing 305, a selector assembly 306, and a tool assembly 308. Unlike golf tool devices 100 and 200, housing 305 of golf tool device 300 is formed with grip 302 of the golf club.

Grip 302 includes a first opening 309 to allow a user to access a button or other user input device of the selector assembly. An end portion of opening 309, which is designated at 310, includes an arch-shaped component 311 to provide better access to a button of the selector assembly. Additionally, grip 302 includes a second opening 312 that exposes the ball marker assembly of tool assembly 308 for access by the user.

Example Features

This section describes additional aspects and features of golf tool devices, presented without limitation as a series of paragraphs, some or all of which may be alphanumerically designated for clarity and efficiency. Each of these paragraphs can be combined with one or more other paragraphs, and/or with disclosure from elsewhere in this application in any suitable manner. Some of the paragraphs below expressly refer to and further limit other paragraphs, providing, without limitation, examples of some of the suitable combinations.

A0. A golf tool device, comprising:
- a housing;
- a tool assembly attached to the housing and including:
  - a base jaw,
  - a gripper jaw pivotably connected to the base jaw, and
  - a spring connected to the gripper jaw and configured to urge the gripper jaw toward the base jaw; and
- a mode selector assembly configured to selectively switch operation of the gripper jaw between at least two modes, including:
  - a first mode in which the gripper jaw moves in response to urging of the spring, and
  - a second mode in which the gripper jaw is secured in a first position that is spaced away from the base jaw against urging of the spring.

A1. The golf tool device of paragraph A0, wherein the mode selector assembly is configured to switch operation of the gripper jaw from the first mode to the second mode by manually pivoting the gripper jaw away from the base jaw against urging of the spring.

A2. The golf tool device of any of paragraphs A0-A1, wherein the mode selector assembly is configured to switch operation of the gripper jaw from the second mode to the first mode by manually pivoting the gripper jaw toward the base jaw.

A3. The golf tool device of any of paragraphs A0-A2, wherein the tool assembly is movably attached to the housing and configured to move between a retracted position in which at least a substantial portion of the tool assembly is enclosed by the housing, and an extended position in which at least a substantial portion of the tool assembly is external the housing.

A4. The golf tool device of any of paragraphs A0-A3, wherein the tool assembly is slidably attached to the housing and configured to move between the retracted and extended positions.

A5. The golf tool device of any of paragraphs A0-A4, further comprising a button that is slidably connected to the housing and configured to move the tool assembly between the retracted and extended positions.

A6. The golf tool device of any of paragraphs A0-A5, wherein the mode selector assembly includes:
- a detent slide pivotably connected to the gripper jaw, the detent slide having a plurality of recesses separated by a plurality of walls;
- a case fixedly attached to the base jaw;
- a spring received in the case; and
- a projecting member having a first end portion received in the case and a second end portion selectively received in a recess of the plurality of recesses.

A7. The golf tool device of paragraph A6, wherein the plurality of recesses includes a first recess and a second recess separated by at least one wall, and wherein, when the second end portion of the projecting member is received in the first recess, the gripper jaw operates in the first mode.

A8. The golf tool device of paragraph A7, wherein, when the second end portion of the projecting member is received in the second recess, the gripper jaw operates in the second mode, the at least one wall preventing the second end portion of the projecting member from moving to the first recess without manual movement of the gripper jaw toward the base jaw.

A9. The golf tool device of any of paragraphs A7-A8, wherein manual movement of the gripper jaw toward the base jaw moves the second end portion of the projecting member over the at least one wall and into the first recess.

A10. The golf tool device any of paragraphs A0-A9, wherein the base jaw includes a divot tool having at least one tine.

A11. The golf tool device of any of paragraphs A0-A10, wherein the gripper jaw is operable in a third mode wherein the gripper jaw is secured in a second position that is spaced away from the base jaw against urging of the spring, and the gripper jaw is more spaced away from the base jaw in the second position relative to the first position.

A12. The golf tool device of paragraph A11, further comprising:
- a detent slide pivotably connected to the gripper jaw, the detent slide having a plurality of recesses separated by a plurality of walls;
- a case fixedly attached to the base jaw;
- a spring received in the case; and
- a projecting member having first and second end portions, the first end portion being received in the case and the second end portion being selectively received in a recess of the plurality of recesses, wherein the plurality of recesses includes first and third recesses and a second recess disposed between the first and third recesses, each of the first, second and third recesses being separated from the other of the first, second, and third recesses by one or more walls.

A13. The golf tool device of paragraph A12, wherein, when the second end portion of the rod is received in the first recess, the gripper jaw operates in the first mode, and wherein, when the second end portion of the rod is received in the second recess, the gripper jaw operates in the second mode, a wall of the one or more walls preventing the second end portion of the rod from moving to the first recess without manual movement of the gripper jaw toward the base jaw.

A14. The golf tool device of any of paragraphs A12-A13, wherein, when the second end portion of the rod is received in the third recess, the gripper jaw operates in the third mode, a wall of the one or more walls preventing the second end portion of the rod from moving to the second recess without manual movement of the gripper jaw toward the base jaw.

A15. The golf tool device of any of paragraphs A12-A14, wherein, when the second end portion of the rod is received in the third recess, manual movement of the gripper jaw toward the base jaw moves the second end portion of the rod over the wall between the second and third recesses and into the second recess.

A16. The golf tool device of any of paragraphs A12-A15, wherein further manual movement of the gripper jaw toward the base jaw moves the second end portion of the rod over the wall between the first and second recesses and into the first recess.

A17. The golf tool device of any of paragraphs A0-A16, wherein the gripper jaw includes a slot configured to removably receive at least one ball marker.

A18. The golf tool device of paragraph A17, wherein the gripper jaw includes an aperture configured to receive only a portion of a ball marker of the at least one ball marker.

A19. The golf tool device of any of paragraphs A17-A18, where the ball marker is metallic, wherein an end portion of the gripper jaw includes at least one magnet that is configured to attract the ball marker.

A20. The golf tool device of any of paragraphs A0-A19, wherein the housing includes a hollow central portion sized to receive a portion of a golf club shaft.

A21. The golf tool device of any of paragraphs A0-A20, wherein the housing is attached to a grip of a golf club.

B0. A golf club, comprising:

a grip;

a shaft having opposed first and second end portions, the first end portion being received in the grip;

a club head attached to the second end portion of the shaft;

a tool assembly attached to, or incorporated with, the grip and including:

a base jaw;

a gripper jaw pivotably connected to the base jaw;

a spring connected to the gripper jaw and configured to urge the gripper jaw toward the base jaw; and a mode selector assembly configured to selectively switch operation of the gripper jaw between at least two modes, including:

a first mode in which the gripper jaw moves relative to the base jaw in response to urging of the spring, and a second mode in which the gripper jaw is secured in a first position that is spaced away from the base jaw against urging of the spring.

B1. The golf club of paragraph B0, wherein the tool assembly is movably attached to the grip and configured to move between a retracted position in which at least a substantial portion of the tool assembly is enclosed by the grip, and an extended position in which at least a substantial portion of the tool assembly is external the grip.

B2. The golf club of paragraph B1, wherein the tool assembly is slidably attached to the grip and configured to move between the retracted and extended positions.

B3. The golf club of paragraph B2, further comprising a button that is slidably connected to the grip and configured to move the tool assembly between the retracted and extended positions.

B4. The golf club of any of paragraphs B0-B3, wherein the gripper jaw includes a slot configured to removably receive at least one ball marker.

B5. The golf club of paragraph B4, wherein the gripper jaw includes an aperture configured to receive only a portion of a ball marker of the at least one ball marker.

B6. The golf club of paragraph B5, where the ball marker is metallic, wherein an end portion of the gripper jaw includes at least one magnet that is configured to attract the ball marker.

B7. The golf club of paragraph B6, wherein the tool assembly is movably attached to the grip and configured to move between a retracted position in which at least a substantial portion of the tool assembly is enclosed by the grip, and an extended position in which at least a substantial portion of the tool assembly is external the grip.

B8. The golf club of paragraph B7, wherein the grip includes an aperture sized to allow a user to access the slot when the tool assembly is in the retracted position.

C. A golf tool device, comprising:

a housing;

a tool assembly attached to the housing and including:

a base jaw, a gripper jaw pivotably connected to the base jaw, and a spring connected to the gripper jaw and configured to urge the gripper jaw toward the base jaw; and means for switching the gripper jaw between at least two modes, including:

a first mode in which the gripper jaw moves relative to the base jaw in response to urging of the spring, and a second mode in which the gripper jaw is secured in a position that is spaced away from the base jaw against urging of the spring.

D0. A golf club grip tool assembly, comprising;

a divot tool having at least one tine;

a gripper jaw pivotably connected to the divot tool and having arcuate portions;

a ball marker tool including a slot disposed on the gripper jaw; and a spring urging the gripper jaw to a closed position;

wherein the gripper jaw is pivotable around a hinge and relative to the divot tool such that the gripper jaw is operable to open, pass around a golf ball, and urge the golf ball against the divot tool;

wherein the golf club grip tool assembly is transitionable between a stowed position and a deployed position and wherein a release button is operable to lock the golf club grip tool assembly in at least one of the stowed position and the deployed position;

wherein the gripper jaw is operable in at least two modes; and wherein a first mode is a ball pick up mode wherein the gripper jaw closes around the golf ball and a second mode is a ball placement mode wherein the gripper jaw remains open against urging of the spring when the gripper jaw is pushed against the golf ball.

D1. The golf club grip tool assembly of paragraph D0, wherein the golf club grip tool assembly is incorporated within a grip of a club.

D2. The golf club grip tool assembly of paragraph D1, wherein at least a portion of the release button is accessible from external the grip.

D3. The golf club grip tool assembly of paragraph D0, wherein the golf club grip tool assembly is attached to a grip of a club.

D4. The golf club grip tool assembly of paragraph D3, further comprising an outer shell that encloses one or more other components of the golf club grip tool assembly.

D5. The golf club grip tool assembly of paragraph D4, wherein the outer shell is detachable.

D6. The golf club grip tool assembly of paragraph D4, wherein the outer shell is configured to move between an extended position in which the outer shell encloses one or more other components of the golf club grip tool assembly, and a retracted position in which at least one component of the one or more components are exposed.

D7. The golf club grip tool assembly of paragraph D4, wherein the gripper jaw and divot tool are within the outer cover in the stowed position, and wherein the gripper jaw and divot tool extend out of the outer cover in the deployed position.

D8. The golf club grip tool assembly of any of paragraphs D0-D7, further comprising a ball marker dispenser tool configured to store one or more ball markers.

D9. The golf club grip tool assembly of any of paragraphs D-D8, further comprising a detent button operable for transitioning the gripper jaw between the at least two modes.

D10. The golf club grip tool assembly of any of paragraphs D-D8, further comprising a plunger and a detent slide for transitioning the gripper jaw between the at least two modes.

D11. The golf club grip tool assembly of paragraph D10, wherein the detent slide includes a plurality of contours and the plunger includes a nose that is configured to engage the plurality of contours to transition the gripper jaw between the at least two modes.

D12. The golf club grip tool assembly of paragraph D11, wherein the plunger includes a spring configured to urge the nose toward the detent slide when the nose engages the plurality of contours.

D13. The golf club grip tool assembly of any of paragraphs D11-J12, wherein the detent slide is attached to the gripper jaw and pivots with the gripper jaw.

D14. The golf club grip tool assembly of any of paragraphs D11-D13, further comprising a body configured to at least partially receive the gripper jaw and the divot tool when the golf club grip tool assembly is in the stowed position, wherein the plunger is fixedly attached to the body and the nose is configured to engage the plurality of contours of the detent slide when the golf club grip tool assembly is in the deployed position.

D15. The golf club grip tool assembly of any of paragraphs D10-D14, wherein a user may move the gripper jaw itself to transition the gripper jaw between the at least two modes.

D16. The golf club grip tool assembly of any of paragraphs D-D15, wherein the gripper jaw is transitioned between at least three modes.

Golf Tool Device Operation

Figure 15:
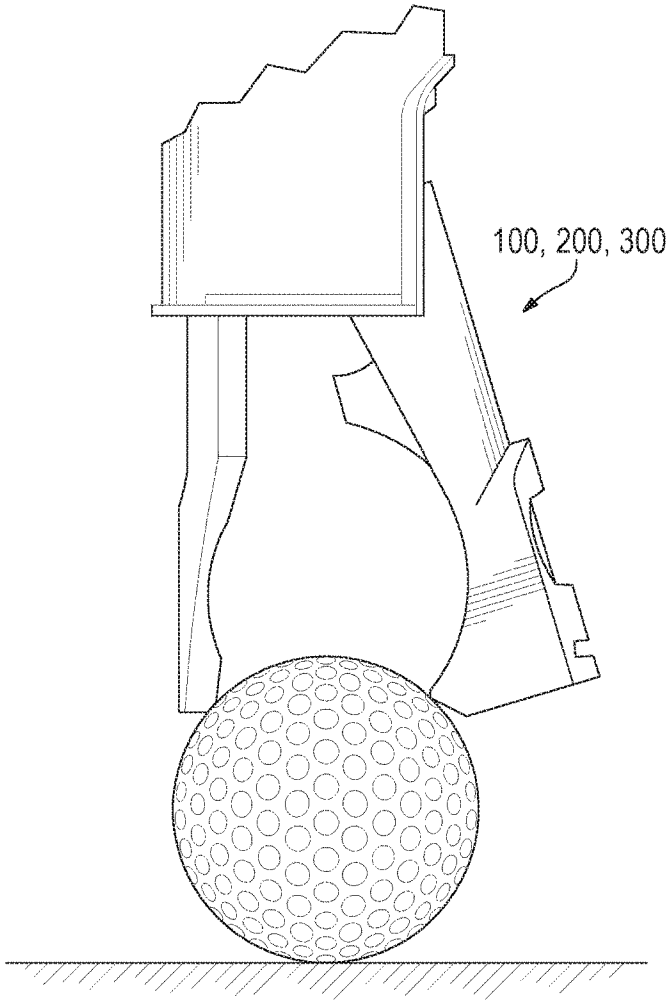
FIG. 15 is a partial view of a golf tool device of the present disclosure in an initial stage of picking up a golf ball.

When a golf ball is on a surface, the tool assembly of the golf tool device can be moved to the extended position and the base jaw and gripper jaw may be positioned in between and on top of the golf ball as shown in FIG. 15. The user may apply a downward force to pivot the gripper jaw away from the base jaw and around the golf ball to accommodate the golf ball. The tool spring urges the gripper jaw toward the base jaw to secure the golf ball between the gripper jaw and the base jaw, as shown in FIG. 16. The user may then lift the golf tool device to pick up and obtain the golf ball.

Figure 17:
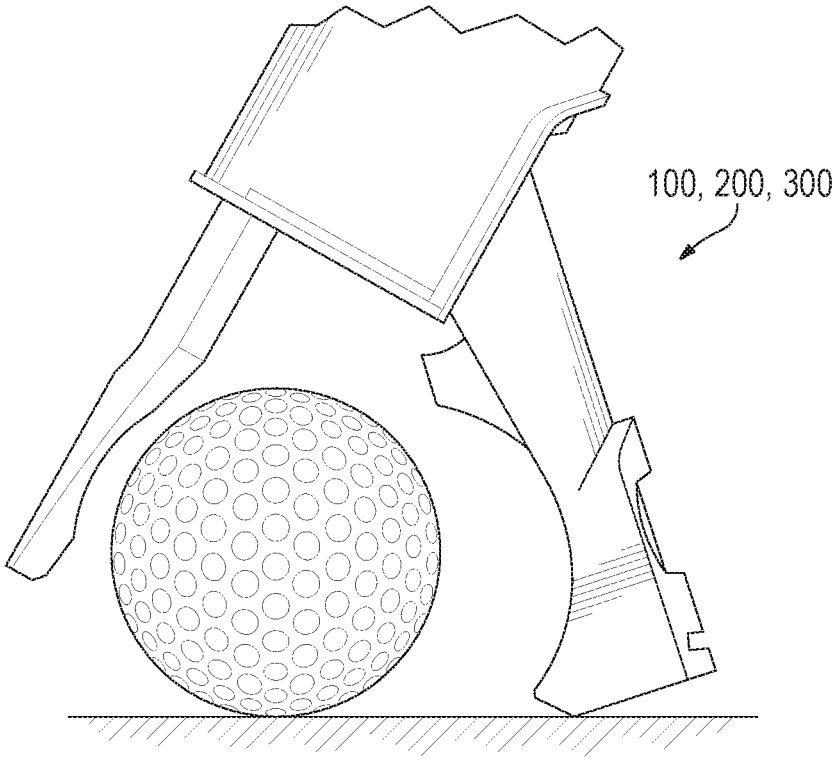
FIG. 17 is a partial view of the golf tool device of FIG. 15 showing manual movement of the gripper jaw against the surface away from the base jaw to release the golf ball.

When a user desires to place a golf ball on a surface, the user inserts a golf ball between the gripper jaw and the base jaw (with the tool spring urging the gripper jaw toward the base jaw) and then lowers the golf tool device to place the golf ball on the surface, as shown in FIG. 16. Once the golf ball is in the desired location on the surface, a user pushes the gripper jaw outward (or away from the base jaw) by, for example, pushing downward on the golf tool device such that the ball contacts the tangs of the gripper jaw and moves the gripper jaw outward or by pushing the gripper jaw on the surface, as shown in FIG. 17. The gripper jaw is then moved to a ball placement mode in which the gripper jaw remains spaced from the base jaw against urging of the tool spring. A user may then lift the golf tool device away from the golf ball. The user may pivot the gripper jaw toward the base jaw from the ball placement mode to the pre-ball placement mode and to the ball pick-up mode and then move the golf tool device to the retracted position.

Figure 18:
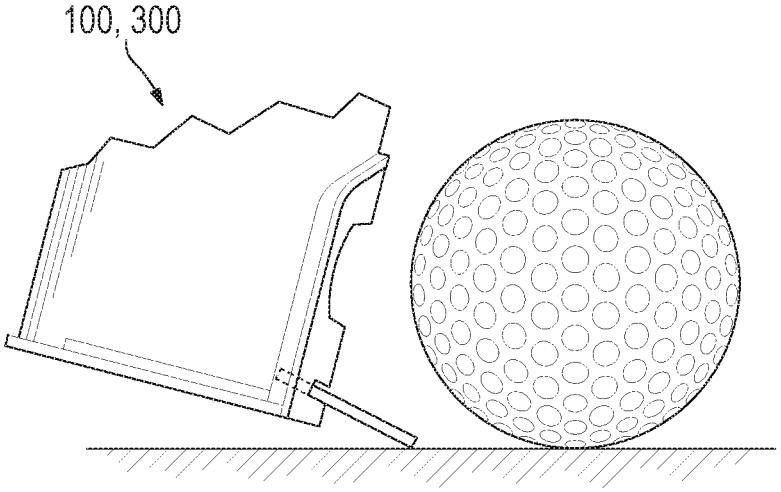
FIG. 18 is a partial view of the golf tool device of FIG. 15 showing placement of a ball marker adjacent to a golf ball on a surface.
Figure 19:
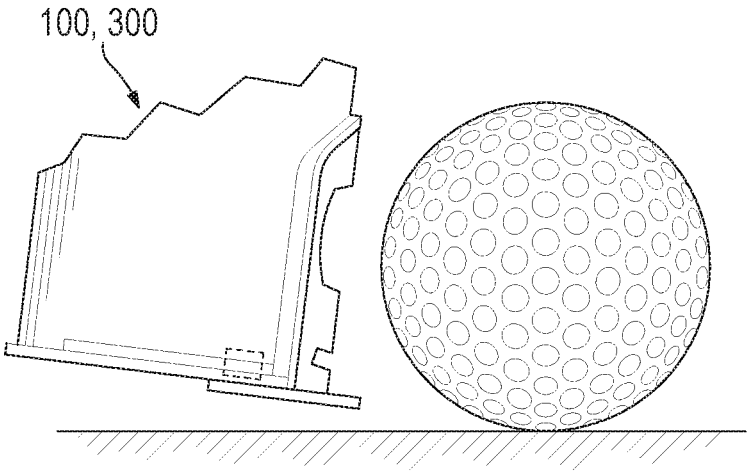
FIG. 19 is a partial view of the golf tool device of FIG. 15 showing pick up of the ball marker.
Figure 20:
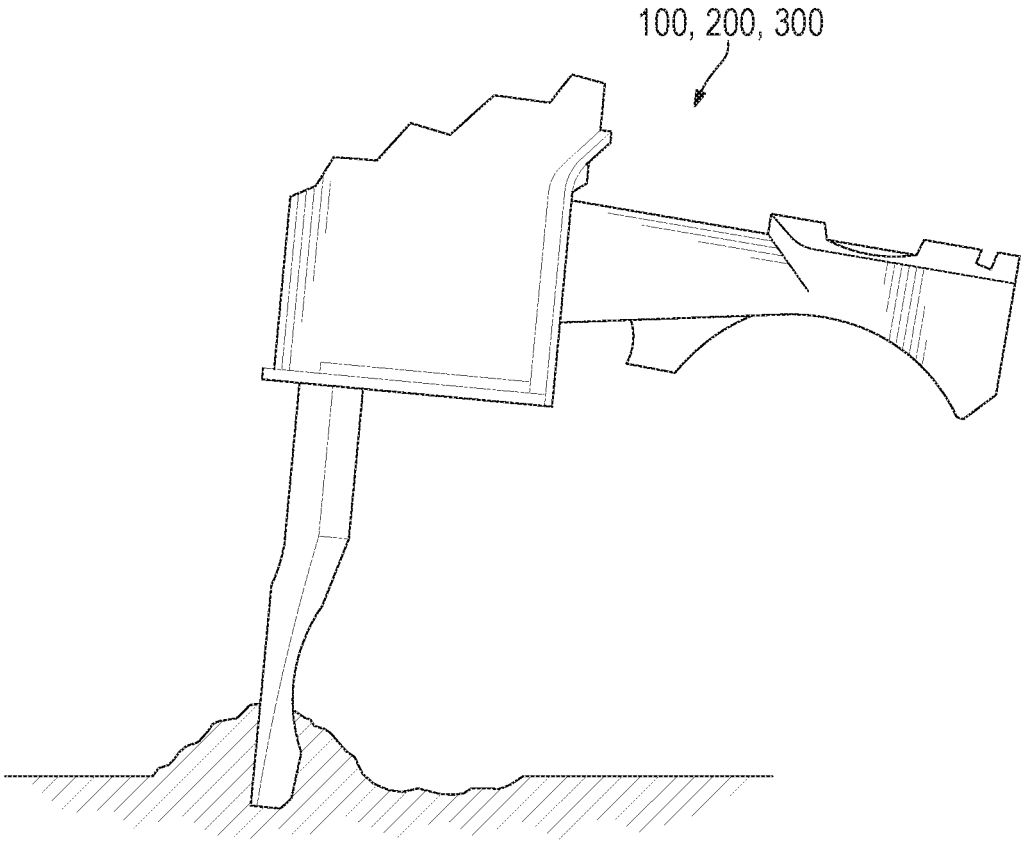
FIG. 20 is a partial view of the golf tool device of FIG. 15 with the gripper jaw moved furthest away from the base jaw to allow a user to use the base jaw to repair a surface.

When a user desires to place a ball marker on a surface (and the golf tool device includes a ball marker), the user may obtain a ball marker from a slot of the gripper jaw and place the ball marker in an aperture of the gripper jaw. The golf tool device is then lowered to place the ball marker in a desired location on the surface, as shown in FIG. 18. Once the ball marker is placed, the user moves the golf tool device away from the ball marker. When a user desires to pick up the ball marker from a surface, the user lowers the golf tool device such that an end of the gripper jaw is adjacent to the ball marker. A magnet in the end of the gripper jaw attracts the ball marker to pick up the ball marker from the surface, as shown in FIG. 19.

When a user desires to repair a surface using a divot tool of the golf tool device, the user may move the golf device to the extended position, and then manually pivot the gripper jaw away from the base jaw to move the gripper jaw to the divot repair mode. The user may then lower the base jaw/divot tool to the surface and repair that surface. To store the golf tool device, the user may pivot the gripper jaw toward the base jaw from the divot repair mode, to the ball placement mode, to the pre-ball placement mode and to the ball pick-up mode and then move the golf tool device to the retracted position.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A golf tool device, comprising:
- a housing;
- a tool assembly attached to the housing and including:
  - a base jaw,
  - a gripper jaw pivotably connected to the base jaw, and
  - a spring connected to the gripper jaw and configured to urge the gripper jaw toward the base jaw; and
- a mode selector assembly configured to selectively switch operation of the gripper jaw between at least two modes, including:
  - a first mode in which the gripper jaw moves in response to urging of the spring, and
  - a second mode in which the gripper jaw is secured in a first position that is spaced away from the base jaw against urging of the spring, wherein the mode selector assembly includes:
- a detent slide pivotably connected to the gripper jaw, the detent slide having a plurality of recesses separated by a plurality of walls;
- a case fixedly attached to the base jaw;
- a case spring received in the case; and
- a projecting member having first and second end portions, the first end portion being received in the case and the second end portion being external the case and selectively received in a recess of the plurality of recesses, wherein the case spring is configured to urge the second end portion of the projecting member toward the recess.

2. The golf tool device of claim 1, wherein the mode selector assembly is configured to switch operation of the gripper jaw from the first mode to the second mode by manually pivoting the gripper jaw away from the base jaw against urging of the spring.

3. The golf tool device of claim 2, wherein the mode selector assembly is configured to switch operation of the gripper jaw from the second mode to the first mode by manually pivoting the gripper jaw toward the base jaw.

4. The golf tool device of claim 1, wherein the tool assembly is movably attached to the housing and configured to move between a retracted position in which at least a substantial portion of the tool assembly is enclosed by the housing, and an extended position in which at least a substantial portion of the tool assembly is external the housing.

5. The golf tool device of claim 1, wherein the plurality of recesses includes a first recess and a second recess separated by at least one wall, and wherein, when the second end portion of the projecting member is received in the first recess, the gripper jaw operates in the first mode, and wherein, when the second end portion of the projecting member is received in the second recess, the gripper jaw operates in the second mode, the at least one wall preventing the second end portion of the projecting member from moving to the first recess without manual movement of the gripper jaw toward the base jaw.

6. The golf tool device of claim 5, wherein manual movement of the gripper jaw toward the base jaw moves the second end portion of the projecting member over the at least one wall and into the first recess.

7. The golf tool device of claim 1, wherein the base jaw includes a divot tool having at least one tine.

8. The golf tool device of claim 7, wherein the gripper jaw is operable in a third mode wherein the gripper jaw is secured in a second position that is spaced away from the base jaw against urging of the spring, and the gripper jaw is more spaced away from the base jaw in the second position relative to the first position.

9. The golf tool device of claim 1, wherein the gripper jaw includes a slot configured to removably receive at least one ball marker.

10. The golf tool device of claim 9, wherein the gripper jaw includes an aperture configured to receive only a portion of a ball marker of the at least one ball marker.

11. The golf tool device of claim 10, where the ball marker is metallic, wherein an end portion of the gripper jaw includes at least one magnet that is configured to attract the ball marker.

12. A golf tool device, comprising:

a housing;

a tool assembly attached to the housing and including:

a base jaw, wherein the base jaw includes a divot tool having at least one tine, a gripper jaw pivotably connected to the base jaw, and a spring connected to the gripper jaw and configured to urge the gripper jaw toward the base jaw;

a mode selector assembly configured to selectively switch operation of the gripper jaw between at least two modes, including:

a first mode in which the gripper jaw moves in response to urging of the spring, a second mode in which the gripper jaw is secured in a first position that is spaced away from the base jaw against urging of the spring, and a third mode wherein the gripper jaw is secured in a second position that is spaced away from the base jaw against urging of the spring, and the gripper jaw is more spaced away from the base jaw in the second position relative to the first position;

a detent slide pivotably connected to the gripper jaw, the detent slide having a plurality of recesses separated by a plurality of walls;

a case fixedly attached to the base jaw;

a case spring received in the case; and a projecting member having first and second end portions, the first end portion being received in the case and the second end portion being external to the case and selectively received in a recess of the plurality of recesses, wherein the case spring is configured to urge the second end portion of the projecting member toward the recess, and wherein the plurality of recesses includes first and third recesses and a second recess disposed between the first and third recesses, each of the first, second and third recesses being separated from the other of the first, second, and third recesses by one or more walls.

13. The golf tool device of claim 12, wherein, when the second end portion of the projecting member is received in the first recess, the gripper jaw operates in the first mode, and wherein, when the second end portion of the projecting member is received in the second recess, the gripper jaw operates in the second mode, a wall of the one or more walls preventing the second end portion of the projecting member from moving to the first recess without manual movement of the gripper jaw toward the base jaw, and wherein, when the second end portion of the projecting member is received in the third recess, the gripper jaw operates in the third mode, a wall of the one or more walls preventing the second end portion of the projecting member from moving to the second recess without manual movement of the gripper jaw toward the base jaw.

14. The golf tool device of claim 13, wherein, when the second end portion of the projecting member is received in the third recess, manual movement of the gripper jaw toward the base jaw moves the second end portion of the projecting member over the wall between the second and third recesses and into the second recess.

15. The golf tool device of claim 14, wherein further manual movement of the gripper jaw toward the base jaw moves the second end portion of the projecting member over the wall between the first and second recesses and into the first recess.

16. The golf tool device of claim 12, wherein the gripper jaw includes a slot configured to removably receive at least one ball marker.

17. The golf tool device of claim 16, wherein the gripper jaw includes an aperture configured to receive only a portion of a ball marker of the at least one ball marker.

18. The golf tool device of claim 17, where the ball marker is metallic, wherein an end portion of the gripper jaw includes at least one magnet that is configured to attract the ball marker.

19. The golf tool device of claim 12, wherein the tool assembly is movably attached to the housing and configured to move between a retracted position in which at least a substantial portion of the tool assembly is enclosed by the housing, and an extended position in which at least a substantial portion of the tool assembly is external the housing.

* * * * *